US009966083B2

(12) United States Patent
Kamamoto et al.

(10) Patent No.: US 9,966,083 B2
(45) **Date of Patent: *May 8, 2018**

(54) LINEAR PREDICTIVE ANALYSIS APPARATUS, METHOD, PROGRAM AND RECORDING MEDIUM

(71) Applicant: NIPPON TELEGRAPH AND TELEPHONE CORPORATION, Chiyoda-ku (JP)

(72) Inventors: Yutaka Kamamoto, Atsugi (JP); Takehiro Moriya, Atsugi (JP); Noboru Harada, Atsugi (JP)

(73) Assignee: NIPPON TELEGRAPH AND TELEPHONE CORPORATION, Chiyoda-ku (JP)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/112,534

(22) PCT Filed: Jan. 20, 2015

(86) PCT No.: PCT/JP2015/051351

§ 371 (c)(1),
(2) Date: Jul. 19, 2016

(87) PCT Pub. No.: WO2015/111568

PCT Pub. Date: Jul. 30, 2015

(65) Prior Publication Data

US 2016/0336019 A1 Nov. 17, 2016

(30) Foreign Application Priority Data

Jan. 24, 2014 (JP) ..... 2014-011317
Jul. 28, 2014 (JP) ..... 2014-152526

(51) Int. Cl.
*G10L 19/00* (2013.01)
*G10L 21/00* (2013.01)
(Continued)

(52) U.S. Cl.
CPC ..... *G10L 19/06* (2013.01); *G10L 25/06* (2013.01); *G10L 25/12* (2013.01); *G10L 25/21* (2013.01); *G10L 25/90* (2013.01)

(58) Field of Classification Search
CPC ..... G10L 19/06; G10L 19/12; G10L 19/032; G10L 19/08; G10L 19/083; G10L 19/125;
(Continued)

(56) References Cited

U.S. PATENT DOCUMENTS 5,243,685 A * 9/1993 Laurent ..... G10L 19/06 704/200
5,781,880 A * 7/1998 Su ..... G10L 19/09 704/207
(Continued)

OTHER PUBLICATIONS

Office Action dated Jul. 3, 2017 in Korean Patent Application No. 10-2016-7019020 (with English language translation).
(Continued)

*Primary Examiner* — Edgar Guerra-Erazo
(74) *Attorney, Agent, or Firm* — Oblon, McClelland, Maier & Neustadt, L.L.P.

(57) ABSTRACT

An autocorrelation calculating part calculates autocorrelation $R_o(i)$ from an input signal. A predictive coefficient calculating part performs linear predictive analysis using modified autocorrelation $R'_o(i)$ obtained by multiplying the autocorrelation $R_o(i)$ by a coefficient $w_o(i)$. Here, a case is comprised where, for at least part of each order i, the coefficient $w_o(i)$ corresponding to each order i monotoni-
(Continued)

cally decreases as a value having positive correlation with a pitch gain in an input signal of a current frame or a past frame increases.

3 Claims, 11 Drawing Sheets

(51) Int. Cl.

| | |
|---|---|
| ***G10L 19/06*** | (2013.01) |
| ***G10L 25/12*** | (2013.01) |
| ***G10L 25/06*** | (2013.01) |
| *G10L 25/90* | (2013.01) |
| *G10L 25/21* | (2013.01) |

(58) Field of Classification Search
CPC ..... G10L 19/04; G10L 2019/0016; G10L 2019/0011; G10L 21/04
See application file for complete search history.

(56) References Cited

U.S. PATENT DOCUMENTS 7,155,386 B2 * 12/2006 Gao ..... G10L 19/005 704/207
2004/0002856 A1 1/2004 Bhaskar et al.
2004/0181397 A1 * 9/2004 Gao ..... G10L 19/005 704/207
2010/0169086 A1 7/2010 Qi et al.
2013/0117030 A1 5/2013 Qi et al.
2016/0343387 A1 * 11/2016 Kamamoto ..... G10L 19/06

OTHER PUBLICATIONS

Yoh'ichi Tohkura, et al., "Spectral Smoothing Technique in PARCOR Speech Analysis-Synthesis", IEEE Transactions on Acoustics, Speech and Signal Processing, vol. ASSP-26, No. 6, Dec. 1978, (10 pages).
"General Aspects of Digital Transmission Systems, Coding of Speech at 8 kbit/s Using Conjugate-Structure Algebraic-Code-Excited Linear-Prediction (CS-ACELP)", International Telecommunication Union, ITU-T Recommendation G.729, Mar. 1996, (39 pages).
"Series G: Transmission Systems and Media, Digital Systems and Networks, Digital terminal equipments—Coding of voice and audio signals; Frame error robust narrow-band and wideband embedded variable bit-rate coding of speech and audio from 8-32 kbit/s", International Telecommunication Union , Recommendation ITU-T G.718, Jun. 2008, (255 pages).
International Search Report dated Apr. 7, 2015 for PCT/JP2015/051351 filed on Jan. 20, 2015.
Extended European Search Report dated Jun. 29, 2017 in Patent Application No. 15740820.4.
3GPP TS 26.445 V12.0.0, "5 Functional description of the encoder", Mobile Competence Centre, XP050907035, Dec. 10, 2014, pp. 31-140.

* cited by examiner

LINEAR PREDICTIVE ANALYSIS APPARATUS, METHOD, PROGRAM AND RECORDING MEDIUM

TECHNICAL FIELD

The present invention relates to a technique of analyzing a digital time series signal such as an audio signal, an acoustic signal, an electrocardiogram, an electroencephalogram, magnetic encephalography and a seismic wave.

BACKGROUND ART

In coding of an audio signal and an acoustic signal, a method for performing coding based on a predictive coefficient obtained by performing linear predictive analysis on the inputted audio signal and acoustic signal is widely used (see, for example, Non-patent literatures 1 and 2).

In Non-patent literatures 1 to 3, a predictive coefficient is calculated by a linear predictive analysis apparatus illustrated in FIG. 11. The linear predictive analysis apparatus 1 comprises an autocorrelation calculating part 11, a coefficient multiplying part 12 and a predictive coefficient calculating part 13.

An input signal which is an inputted digital audio signal or digital acoustic signal in a time domain is processed for each frame of N samples. An input signal of a current frame which is a frame to be processed at current time is set at $X_o(n)$ (n=0, 1, . . . , N−1). n indicates a sample number of each sample in the input signal, and N is a predetermined positive integer. Here, an input signal of the frame one frame before the current frame is $X_o(n)$ (n=−N, −N+1, . . . , −1), and an input signal of the frame one frame after the current frame is $X_o(n)$ (n=N, N+1, . . . , 2N−1).

[Autocorrelation Calculating Part 11]

The autocorrelation calculating part 11 of the linear predictive analysis apparatus 1 obtains autocorrelation $R_o(i)$ (i=0, 1 . . . . , $P_{max}$, where $P_{max}$ is a prediction order) from the input signal $X_o(n)$ using equation (11) and outputs the autocorrelation. $P_{max}$ is a predetermined positive integer less than N.

[Formula 1]

$$R_o(i) = \sum_{n=i}^{N-1} X_o(n) \times X_o(n-i) \tag{11}$$

[Coefficient Multiplying Part 12]

Next, the coefficient multiplying part 12 obtains modified autocorrelation $R'_o(i)$ (i=0, 1, . . . , $P_{max}$) by multiplying the autocorrelation $R_o(i)$ outputted from the autocorrelation calculating part 11 by a coefficient $w_o(i)$ (i=0, 1, . . . , $P_{max}$) defined in advance for each of the same i. That is, the modified autocorrelation function $R'_o(i)$ is obtained using equation (12).

[Formula 2]

$$R'_o(i)=R_o(i)\times w_o(i) \tag{12}$$

[Predictive Coefficient Calculating Part 13]

Then, the predictive coefficient calculating part 13 obtains a coefficient which can be converted into linear predictive coefficients from the first-order to the $P_{max}$-order which is a prediction order defined in advance using the modified autocorrelation $R'_o(i)$ outputted from the coefficient multiplying part 12 through, for example, a Levinson-Durbin method, or the like. The coefficient which can be converted into the linear predictive coefficients comprises a PARCOR coefficient $K_o(1)$, $K_o(2)$, . . . , $K_o(P_{max})$, linear predictive coefficients $a_o(1)$, $a_o(2)$, . . . , $a_o(P_{max})$, or the like.

International Standard ITU-T G.718 which is Non-patent literature 1 and International Standard ITU-T G.729 which is Non-patent literature 2 use a fixed coefficient having a bandwidth of 60 Hz obtained in advance as a coefficient $w_o(i)$.

Specifically, the coefficient $w_o(i)$ is defined using an exponent function as in equation (13), and in equation (13), a fixed value of $f_0$=60 Hz is used. $f_s$ is a sampling frequency.

[Formula 3]

$$w_o(i) = \exp\left(-\frac{1}{2}\left(\frac{2\pi f_0 i}{f_s}\right)^2\right),\ i = 0, 1, \ldots, P_{max} \tag{13}$$

Non-patent literature 3 discloses an example where a coefficient based on a function other than the above-described exponent function is used. However, the function used here is a function based on a sampling period (corresponding to a period corresponding to $f_s$) and a predetermined constant a, and a coefficient of a fixed value is used.

PRIOR ART LITERATURE

Non-Patent Literature

Non-patent literature 1: ITU-T Recommendation G.718, ITU, 2008.

Non-patent literature 2: ITU-T Recommendation G.729, ITU, 1996

Non-patent literature 3: Yoh'ichi Tohkura, Fumitada Itakura, Shin'ichiro Hashimoto, "Spectral Smoothing Technique in PARCOR Speech Analysis-Synthesis", IEEE Trans. on Acoustics, Speech, and Signal Processing, Vol. ASSP-26, No. 6, 1978

SUMMARY OF THE INVENTION

Problems to be Solved by the Invention

In a linear predictive analysis method used in conventional coding of an audio signal or an acoustic signal, a coefficient which can be converted into linear predictive coefficients is obtained using modified autocorrelation $R'_o(i)$ obtained by multiplying autocorrelation $R_o(i)$ by a fixed coefficient $w_o(i)$. Therefore, even if a coefficient which can be converted into linear predictive coefficients is obtained without the need of modification through multiplication of autocorrelation $R_o(i)$ by the coefficient $w_o(i)$, that is, using the autocorrelation $R_o(i)$ itself instead of using the modified autocorrelation $R'_o(i)$, in the case of an input signal whose spectral peak does not become too high in a spectral envelope corresponding to the coefficient which can be converted into the linear predictive coefficients, precision of approximation of the spectral envelope corresponding to the coefficient which can be converted into the linear predictive coefficients obtained using the modified autocorrelation $R'_o(i)$ to a spectral envelope of the input signal $X_o(n)$ may degrade due to multiplication of the autocorrelation $R_o(i)$ by the coefficient $w_o(i)$. That is, there is a possibility that precision of linear predictive analysis may degrade.

An object of the present invention is to provide a linear predictive analysis method, apparatus, a program and a recording medium with higher analysis precision than conventional one.

Means to Solve the Problems

A linear predictive analysis method according to one aspect of the present invention is a linear predictive analysis method for obtaining a coefficient which can be converted into a linear predictive coefficient corresponding to an input time series signal for each frame which is a predetermined time interval, the linear predictive analysis method comprising an autocorrelation calculating step of calculating autocorrelation $R_o(i)$ ($i=0, 1, \ldots, P_{max}$) between an input time series signal $X_o(n)$ of a current frame and an input time series signal $X_o(n-i)$ i sample before the input time series signal $X_o(n)$ or an input time series signal $X_o(n+i)$ i sample after the input time series signal $X_o(n)$ for each of at least $i=0, 1, \ldots, P_{max}$, and a predictive coefficient calculating step of obtaining a coefficient which can be converted into linear predictive coefficients from the first-order to the $P_{max}$-order using modified autocorrelation $R'_o(i)$ ($i=0, 1, \ldots, P_{max}$) obtained by multiplying autocorrelation $R_o(i)$ ($i=0, 1, \ldots, P_{max}$) by a coefficient $w_o(i)$ ($i=0, 1, \ldots, P_{max}$) for each corresponding i, and, for at least part of each order i, the coefficient $w_o(i)$ corresponding to each order i monotonically decreases as a value having positive correlation with intensity of periodicity of an input time series signal of a current frame or a past frame or a pitch gain based on the input time series signal increases.

A linear predictive analysis method according to one aspect of the present invention is a linear predictive analysis method for obtaining a coefficient which can be converted into a linear predictive coefficient corresponding to an input time series signal for each frame which is a predetermined time interval, the linear predictive analysis method comprising an autocorrelation calculating step of calculating autocorrelation $R_o(i)$ ($i=0, 1, \ldots, P_{max}$) between an input time series signal $X_o(n)$ of a current frame and an input time series signal $X_o(n-i)$ i sample before the input time series signal $X_o(n)$ or an input time series signal $X_o(n+i)$ i sample after the input time series signal $X_o(n)$ for each of at least $i=0, 1, \ldots, P_{max}$, a coefficient determining step of acquiring a coefficient $w_o(i)$ ($i=0, 1, \ldots, P_{max}$) from one coefficient table among two or more coefficient tables using a value having positive correlation with intensity of periodicity of an input time series signal of the current frame or a past frame or a pitch gain based on the input time series signal assuming that each order i where $i=0, 1, \ldots, P_{max}$ and a coefficient $w_o(i)$ corresponding to each order i are stored in association with each other in each of the two or more coefficient tables, and a predictive coefficient calculating step of obtaining a coefficient which can be converted into linear predictive coefficients from the first-order to the $P_{max}$-order using modified autocorrelation $R'_o(i)$ ($i=0, 1, \ldots, P_{max}$) obtained by multiplying the autocorrelation $R_o(i)$ ($i=0, 1, \ldots, P_{max}$) by the acquired coefficient $w_o(i)$ ($i=0, 1, \ldots, P_{max}$) for each corresponding i, and, among the two or more coefficient tables, a coefficient table from which the coefficient $w_o(i)$ ($i=0, 1, \ldots, P_{max}$) is acquired in the coefficient determining step when the value having positive correlation with the intensity of the periodicity or the pitch gain is a first value is set as a first coefficient table, and, among the two or more coefficient tables, a coefficient table from which the coefficient $w_o(i)$ ($i=0, 1, \ldots, P_{max}$) is acquired in the coefficient determining step when the value having positive correlation with the intensity of the periodicity or the pitch gain is a second value which is smaller than the first value, is set as a second coefficient table, and, for at least part of each order i, a coefficient corresponding to each order i in the second coefficient table is greater than a coefficient corresponding to each order i in the first coefficient table.

A linear predictive analysis method according to one aspect of the present invention is a linear predictive analysis method for obtaining a coefficient which can be converted into a linear predictive coefficient corresponding to an input time series signal for each frame which is a predetermined time interval, the linear predictive analysis method comprising an autocorrelation calculating step of calculating autocorrelation $R_o(i)$ ($i=0, 1, \ldots, P_{max}$) between an input time series signal $X_o(n)$ of a current frame and an input time series signal $X_o(n-i)$ i sample before the input time series signal $X_o(n)$ or an input time series signal $X_o(n+i)$ i sample after the input time series signal $X_o(n)$ for each of at least $i=0, 1, \ldots, P_{max}$, a coefficient determining step of acquiring a coefficient from one coefficient table among coefficient tables t0, t1 and t2 using a value having positive correlation with intensity of periodicity of an input time series signal of the current frame or a past frame or a pitch gain based on the input time series signal assuming that a coefficient $w_{t0}(i)$ ($i=0, 1, \ldots, P_{max}$) is stored in the coefficient table t0, a coefficient $w_{t1}(i)$ ($i=0, 1, \ldots, P_{max}$) is stored in the coefficient table t1 and a coefficient $w_{t2}(i)$ ($i=0, 1, \ldots, P_{max}$) is stored in the coefficient table t2, and a predictive coefficient calculating step of obtaining a coefficient which can be converted into linear predictive coefficients from the first-order to the $P_{max}$-order using modified autocorrelation $R'_o(i)$ ($i=0, 1, \ldots, P_{max}$) obtained by multiplying the autocorrelation $R_o(i)$ ($i=0, 1, \ldots, P_{max}$) by the acquired coefficient for each corresponding i, and, assuming that, according to the value having positive correlation with the intensity of the periodicity or the pitch gain, a case is classified into any of a case where the intensity of the periodicity or the pitch gain is high, a case where the intensity of the periodicity or the pitch gain is medium and a case where the intensity of the periodicity or the pitch gain is low, a coefficient table from which the coefficient is acquired in the coefficient determining step when the intensity of the periodicity or the pitch gain is high is set as a coefficient table t0, a coefficient table from which the coefficient is acquired in the coefficient determining step when the intensity of the periodicity or the pitch gain is medium is set as a coefficient table t1, and a coefficient table from which the coefficient is acquired in the coefficient determining step when the intensity of periodicity or the pitch gain is low is set as a coefficient table t2, for at least part of i, $w_{t0}(i)<w_{t1}(i)\leq w_{t2}(i)$, and for at least part of each i among other i, $w_{t0}(i)\leq w_{t1}(i)<w_{t2}(i)$, and for the remaining each i, $w_{t0}(i)\leq w_{t1}(i)\leq w_{t2}(i)$.

Effects of the Invention

It is possible to realize linear prediction with higher analysis precision than a conventional one.

DETAILED DESCRIPTION OF THE EMBODIMENTS

Each embodiment of a linear predictive analysis apparatus and method will be described below with reference to the drawings.

First Embodiment

Figure 1:
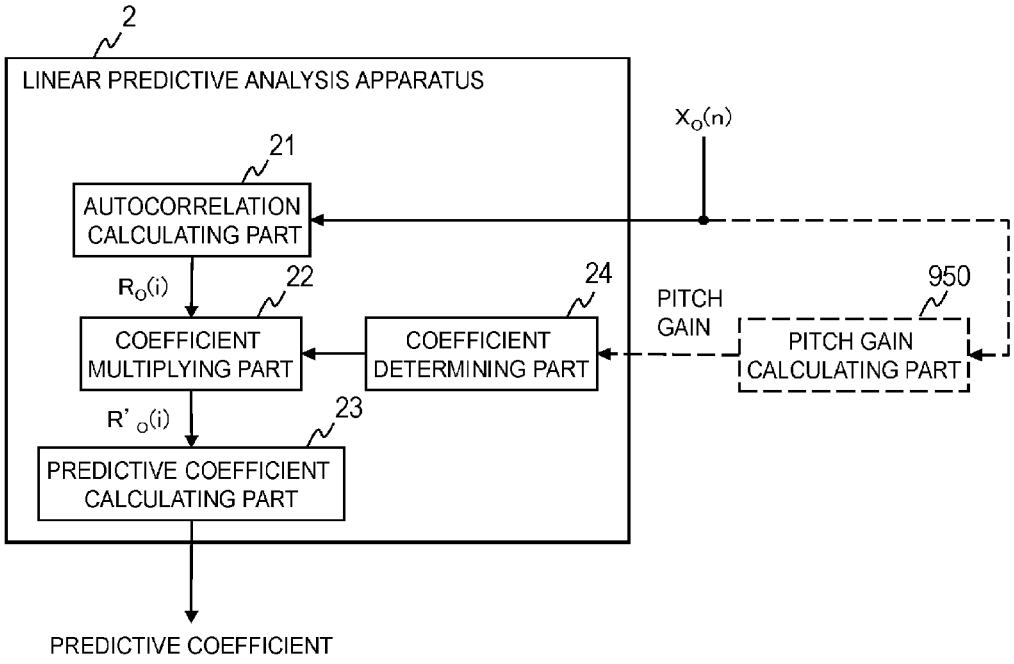
FIG. 1 is a block diagram for explaining an example of a linear predictive apparatus according to a first embodiment and a second embodiment.

As illustrated in FIG. 1, a linear predictive analysis apparatus 2 of the first embodiment comprises, for example, an autocorrelation calculating part 21, a coefficient determining part 24, a coefficient multiplying part 22 and a predictive coefficient calculating part 23. Each operation of the autocorrelation calculating part 21, the coefficient multiplying part 22 and the predictive coefficient calculating part 23 is the same as each operation of an autocorrelation calculating part 11, a coefficient multiplying part 12 and a predictive coefficient calculating part 13 in a conventional linear predictive analysis apparatus 1.

To the linear predictive analysis apparatus 2, an input signal $X_o(n)$ which is a digital audio signal or a digital acoustic signal in a time domain for each frame which is a predetermined time interval, or a digital signal such as an electrocardiogram, an electroencephalogram, magnetic encephalography and a seismic wave is inputted. The input signal is an input time series signal. An input signal of the current frame is set at $X_o(n)$ (n=0, 1, . . . , N−1). n indicates a sample number of each sample in the input signal, and N is a predetermined positive integer. Here, an input signal of the frame one frame before the current frame is $X_o(n)$ (n=−N, −N+1, . . . , −1), and an input signal of the frame one frame after the current frame is $X_o(n)$ (n=N, N+1, . . . , 2N−1). In the following, a case will be described where the input signal $X_o(n)$ is a digital audio signal or a digital acoustic signal. The input signal $X_o(n)$ (n=0, 1, . . . , N−1) may be a picked up signal itself, a signal whose sampling rate is converted for analysis, a signal subjected to pre-emphasis processing or a signal multiplied by a window function.

Further, information regarding a pitch gain of a digital audio signal or a digital acoustic signal for each frame is also inputted to the linear predictive analysis apparatus 2. The information regarding the pitch gain is obtained at a pitch gain calculating part 950 outside the linear predictive analysis apparatus 2.

The pitch gain is intensity of periodicity of an input signal for each frame. The pitch gain is, for example, normalized correlation between signals with time difference by a pitch period for the input signal or a linear predictive residual signal of the input signal.

[Pitch Gain Calculating Part 950]

The pitch gain calculating part 950 obtains a pitch gain G from all or part of an input signal $X_o(n)$ (n=0, 1, . . . , N−1) of the current frame and/or input signals of frames near the current frame. The pitch gain calculating part 950 obtains, for example, a pitch gain G of a digital audio signal or a digital acoustic signal in a signal section comprising all or part of the input signal $X_o(n)$ (n=0, 1, . . . , N−1) of the current frame and outputs information which can specify the pitch gain G as information regarding the pitch gain. There are various publicly known methods for obtaining a pitch gain, and any publicly known method may be employed. Further, it is also possible to employ a configuration where the obtained pitch gain G is encoded to obtain a pitch gain code, and the pitch gain code is outputted as the information regarding the pitch gain. Still further, it is also possible to employ a configuration where a quantization value ˆG of the pitch gain corresponding to the pitch gain code is obtained and the quantization value ˆG of the pitch gain is outputted as the information regarding the pitch gain. A specific example of the pitch gain calculating part 950 will be described below.

Specific Example 1 of Pitch Gain Calculating Part 950

A specific example 1 of the pitch gain calculating part 950 is an example where the input signal $X_o(n)$ (n=0, 1, . . . , N−1) of the current frame is constituted with a plurality of subframes, and the pitch gain calculating part 950 performs operation before the linear predictive analysis apparatus 2 performs operation for the same frame. The pitch gain calculating part 950 first obtains $G_{s1}$, . . . , $G_{sM}$ which are respectively pitch gains of $X_{Os1}(n)$ (n=0, 1, . . . , N/M−1), . . . , $X_{OsM}(n)$ (n=(M−1)N/M, (M−1)N/M+1, . . . , N−1) which are M subframes where M is an integer of two or greater. It is assumed that N is divisible by M. The pitch gain calculating part 950 outputs information which can specify a maximum value max ($G_{s1}$, . . . , $G_{sM}$) among $G_{s1}$, . . . , $G_{sM}$ which are pitch gains of M subframes constituting the current frame as the information regarding the pitch gain.

Specific Example 2 of Pitch Gain Calculating Part 950

A specific example 2 of the pitch gain calculating part 950 is an example where a signal section comprising a look-ahead portion is constituted with the input signal $X_o(n)$ (n=0, 1, . . . , N−1) of the current frame and the input signal $X_o(n)$ (n=N, N+1, . . . , N+Nn−1) (where Nn is a predetermined positive integer which satisfies Nn<N) of part of the frame one frame after the current frame as a signal section of the current frame, and the pitch gain calculating part 950 performs operation after the linear predictive analysis apparatus 2 performs operation for the same frame. The pitch gain calculating part 950 obtains $G_{now}$ and $G_{next}$ which are respectively pitch gains of the input signal $X_o(n)$ (n=0, 1, . . . , N−1) of the current frame and the input signal $X_o(n)$ (n=N, N+1, . . . , N+Nn−1) of part of the frame one frame after the current frame for a signal section of the current frame and stores the pitch gain $G_{next}$ in the pitch gain calculating part 950. Further, the pitch gain calculating part 950 outputs information which can specify the pitch gain $G_{next}$ which is obtained for a signal section of the frame one frame before the current frame and stored in the pitch gain calculating part 950, that is, a pitch gain obtained for the input signal $X_o(n)$ (n=0, 1, . . . , Nn−1) of part of the current frame in the signal section of the frame one frame before the current frame as the information regarding the pitch gain. It should be noted that as in the specific example 1, it is also possible to obtain a pitch gain for each of a plurality of subframes for the current frame.

Specific Example 3 of Pitch Gain Calculating Part 950

A specific example 3 of the pitch gain calculating part 950 is an example where the input signal $X_o(n)$ (n=0, 1, . . . , N−1) itself of the current frame is constituted as a signal section of the current frame, and the pitch gain calculating part 950 performs operation after the linear predictive analysis apparatus 2 performs operation for the same frame. The pitch gain calculating part 950 obtains a pitch gain G of the input signal $X_o(n)$ (n=0, 1, . . . , N−1) of the current frame which is a signal section of the current frame and stores the pitch gain G in the pitch gain calculating part 950. Further, the pitch gain calculating part 950 outputs information which can specify the pitch gain G which is obtained for a signal section of the frame one frame before the current frame, that is, the input signal $X_o(n)$ (n=−N, −N+1, . . . , −1) of the frame one frame before the current frame and stored in the pitch gain calculating part 950 as the information regarding the pitch gain.

Figure 2:
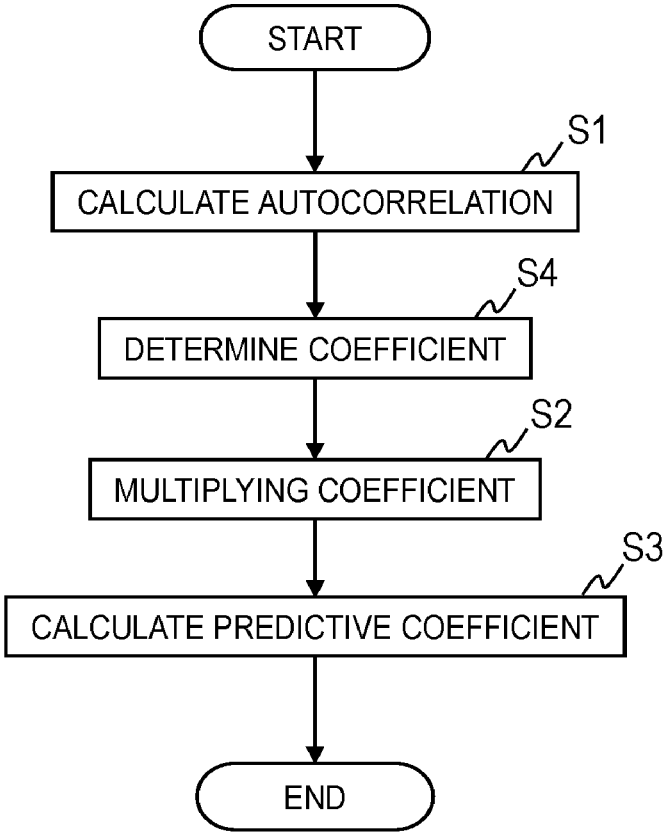
FIG. 2 is a flowchart for explaining an example of a linear predictive analysis method.

The operation of the linear predictive analysis apparatus 2 will be described below. FIG. 2 is a flowchart of a linear predictive analysis method by the linear predictive analysis apparatus 2.

[Autocorrelation Calculating Part 21]

The autocorrelation calculating part 21 calculates autocorrelation $R_o(i)$ (i=0, 1, . . . , $P_{max}$) from the input signal $X_o(n)$ (n=0, 1, . . . , N−1) which is a digital audio signal or a digital acoustic signal in a time domain for each frame of inputted N samples (step S1). $P_{max}$ is a maximum order of a coefficient which can be converted into a linear predictive coefficient, obtained by the predictive coefficient calculating part 23, and is a predetermined positive integer less than N. The calculated autocorrelation $R_o(i)$ (i=0, 1, . . . , $P_{max}$) is provided to the coefficient multiplying part 22.

The autocorrelation calculating part 21 calculates the autocorrelation $R_o(i)$ (i=0, 1, . . . , $P_{max}$) through, for example, equation (14A) using the input signal $X_o(n)$ and outputs the autocorrelation $R_o(i)$ (i=0, 1, . . . , $P_{max}$). That is, the autocorrelation calculating part 21 calculates autocorrelation $R_o(i)$ between the input time series signal $X_o(n)$ of the current frame and an input time series signal $X_o(n-i)$ i sample before the input time series signal $X_o(n)$.

[Formula 4]

$$R_o(i) = \sum_{n=i}^{N-1} X_o(n) \times X_o(n-i) \tag{14A}$$

Alternatively, the autocorrelation calculating part 21 calculates the autocorrelation $R_o(i)$ (i=0, 1, . . . , $P_{max}$) through, for example, equation (14B) using the input signal $X_o(n)$. That is, the autocorrelation calculating part 21 calculates the autocorrelation $R_o(i)$ between the input time series signal $X_o(n)$ of the current frame and an input time series signal $X_o(n+i)$ i sample after the input time series signal $X_o(n)$.

[Formula 5]

$$R_o(i) = \sum_{n=0}^{N-1-i} X_o(n) \times X_o(n+i) \tag{14B}$$

Alternatively, the autocorrelation calculating part 21 may calculate the autocorrelation $R_o(i)$ (i=0, 1, . . . , $P_{max}$) according to Wiener-Khinchin theorem after obtaining a power spectrum corresponding to the input signal $X_o(n)$. Further, in any method, the autocorrelation $R_o(i)$ may be calculated using part of input signals such as input signals $X_o(n)$ (n=−Np, −Np+1, . . . , −1, 0, 1, . . . , N−1, N, . . . , N−1+Nn), of frames before and after the current frame. Here, Np and Nn are respectively predetermined positive integers which satisfy Np<N and Nn<N. Alternatively, it is also possible to use as a substitute an MDCT series as an approximation of the power spectrum and obtain autocorrelation from the approximated power spectrum. In this manner, any publicly known technique which is commonly used may be employed as a method for calculating autocorrelation.

[Coefficient Determining Part 24]

The coefficient determining part 24 determines a coefficient $w_o(i)$ (i=0, 1, . . . , $P_{max}$) using the inputted information regarding the pitch gain (step S4). The coefficient $w_o(i)$ is a coefficient for modifying the autocorrelation $R_o(i)$. The coefficient $w_o(i)$ is also referred to as a lag window $w_o(i)$ or a lag window coefficient $w_o(i)$ in a field of signal processing. Because the coefficient $w_o(i)$ is a positive value, when the coefficient $w_o(i)$ is greater/smaller than a predetermined value, it is sometimes expressed that the magnitude of the coefficient $w_o(i)$ is larger/smaller than that of the predetermined value. Further, the magnitude of $w_o(i)$ means a value of $w_o(i)$.

The information regarding the pitch gain inputted to the coefficient determining part 24 is information for specifying a pitch gain obtained from all or part of the input signal of the current frame and/or input signals of frames near the current frame. That is, the pitch gain to be used to determine the coefficient $w_o(i)$ is a pitch gain obtained from all or part of the input signal of the current frame and/or the input signals of the frames near the current frame.

The coefficient determining part 24 determines as the coefficients $w_o(0)$, $w_o(1)$, . . . , $w_o(P_{max})$ a smaller value for a greater pitch gain corresponding to the information regarding the pitch gain in all or part of a possible range of the pitch gain corresponding to the information regarding the pitch gain for all or part of orders from the 0-th order to the $P_{max}$-order. Further, the coefficient determining part 24 may determine a smaller value for a greater pitch gain as the coefficients $w_o(0)$, $w_o(1)$, . . . , $w_o(P_{max})$ using a value having positive correlation with the pitch gain instead of using the pitch gain.

That is, the coefficient $w_o(i)$ (i=0, 1, . . . , $P_{max}$) is determined so as to comprise a case where, for at least part of prediction order i, the magnitude of the coefficient $w_o(i)$ corresponding to the order i monotonically decreases as the value having positive correlation with the pitch gain in a signal section comprising all or part of the input signal $X_o(n)$ of the current frame increases.

In other words, as will be described later, the magnitude of the coefficient $w_o(i)$ does not have to monotonically decrease as the value having positive correlation with the pitch gain increases depending on the order i.

Further, while a possible range of the value having positive correlation with the pitch gain may comprise a range where the magnitude of the coefficient $w_o(i)$ is fixed although the value having positive correlation with the pitch gain increases, in other ranges, the magnitude of the coefficient $w_o(i)$ monotonically decreases as the value having positive correlation with the pitch gain increases.

The coefficient determining part 24, for example, determines the coefficient $w_o(i)$ using a monotonically nonincreasing function for the pitch gain corresponding to the inputted information regarding the pitch gain. For example, the coefficient determining part 24 determines the coefficient $w_o(i)$ through the following equation (2) using $\alpha$ which is a value defined in advance greater than zero. In equation (2), G means a pitch gain corresponding to the inputted information regarding the pitch gain. $\alpha$ is a value for adjusting a width of a lag window when the coefficient $w_o(i)$ is regarded as a lag window, in other words, intensity of the lag window. $\alpha$ defined in advance may be determined by, for example, encoding and decoding an audio signal or an acoustic signal for a plurality of candidate values for $\alpha$ at an encoding apparatus comprising the linear predictive analysis apparatus 2 and at a decoding apparatus corresponding to the encoding apparatus and selecting a candidate value whose subjective quality or objective quality of the decoded audio signal or the decoded acoustic signal is favorable as $\alpha$.

[Formula 6]

$$w_o(i) = \exp\left(-\frac{1}{2}\left(\frac{2\pi\alpha G i}{f_s}\right)^2\right),\ i = 0, 1, \ldots, P_{max} \tag{2}$$

Alternatively, the coefficient $w_o(i)$ may be determined through the following equation (2A) using a function f(G) defined in advance for the pitch gain G. The function f(G) is a function which has positive correlation with the pitch gain G, and which has monotonically nondecreasing relationship with respect to the pitch gain G, such as $f(G)=\alpha G+\beta$ (where $\alpha$ is a positive number and $\beta$ is an arbitrary number) and $f(G)=\alpha G^2+\beta G+\gamma$ (where $\alpha$ is a positive number, and $\beta$ and $\gamma$ are arbitrary numbers).

[Formula 7]

$$w_o(i) = \exp\left(-\frac{1}{2}\left(\frac{2\pi f(G) i}{f_s}\right)^2\right),\ i = 0, 1, \ldots, P_{max} \tag{2A}$$

Further, an equation used to determine the coefficient $w_o(i)$ using the pitch gain G is not limited to the above-described (2) and (2A), and other equations can be used if an equation can express monotonically nonincreasing relationship with respect to increase of the value having positive correlation with the pitch gain. For example, the coefficient $w_o(i)$ may be determined using any of the following equations (3) to (6). In the following equations (3) to (6), a is set as a real number determined depending on the pitch gain, and in is set as a natural number determined depending on the pitch gain. For example, $\alpha$ is set as a value having negative correlation with the pitch gain, and m is set as a value having negative correlation with the pitch gain. $\tau$ is a sampling period.

[Formula 8]

$$w_o(i) = 1 - \tau i / a,\ i = 0, 1, \ldots, P_{max} \tag{3}$$

$$w_o(i) = \binom{2m}{m-i} \Big/ \binom{2m}{m},\ i = 0, 1, \ldots, P_{max} \tag{4}$$

$$w_o(i) = \left(\frac{\sin a\tau i}{a\tau i}\right)^2,\ i = 0, 1, \ldots, P_{max} \tag{5}$$

$$w_o(i) = \left(\frac{\sin a\tau i}{a\tau i}\right),\ i = 0, 1, \ldots, P_{max} \tag{6}$$

The equation (3) is a window function in a form called "Bartlett window", the equation (4) is a window function in a form called "Binomial window" defined using a binomial coefficient, the equation (5) is a window function in a form called "Triangular in frequency domain window", and the equation (6) is a window function in a form called "Rectangular in frequency domain window".

It should be noted that the coefficient $w_o(i)$ may monotonically decrease as the value having positive correlation with the pitch gain increases only for at least part of order i, not for each i of $0 \le i \le P_{max}$. In other words, the magnitude of the coefficient $w_o(i)$ does not have to monotonically decrease as the value having positive correlation with the pitch gain increases depending on the order i.

For example, when i=0, the value of the coefficient $w_o(0)$ may be determined using any of the above-described equations (2) to (6), or a fixed value, such as $w_o(0)=1.0001$, $w_o(0)=1.003$ as also used in ITU-T G.718, or the like, which does not depend on the value having positive correlation with the pitch gain and which is empirically obtained, may be used. That is, for each i of $1 \le i \le P_{max}$, while the value of the coefficient $w_o(i)$ is smaller as the value having positive correlation with the pitch gain is greater, the coefficient when i=0 is not limited to this, and a fixed value may be used.

[Coefficient Multiplying Part 22]

The coefficient multiplying part 22 obtains modified autocorrelation $R'_o(i)$ (i=0, 1, . . . , $P_{max}$) by multiplying the autocorrelation $R_o(i)$ (i=0, 1, . . . , $P_{max}$) obtained at the autocorrelation calculating part 21 by the coefficient $w_o(i)$ (i=0, 1, . . . , $P_{max}$) determined at the coefficient determining part 24 for each of the same i (step S2). That is, the coefficient multiplying part 22 calculates the autocorrelation $R'_o(i)$ through the following equation (7). The calculated autocorrelation $R'_o(i)$ is provided to the predictive coefficient calculating part 23.

[Formula 9]

$$R'_o(i) = R_o \times w_o(i) \tag{7}$$

[Predictive Coefficient Calculating Part 23]

The predictive coefficient calculating part 23 obtains a coefficient which can be converted into a linear predictive coefficient using the modified autocorrelation K(i) outputted from the coefficient multiplying part 22 (step S3).

For example, the predictive coefficient calculating part 23 calculates and outputs PARCOR coefficients $K_o(1)$, $K_o(2)$, $K_o(P_{max})$ from the first-order to the $P_{max}$-order which is a maximum order defined in advance or linear predictive coefficients $a_o(1)$, $a_o(2)$, . . . , $a_o(P_{max})$ using a Levinson- Durbin method, or the like, using the modified autocorrelation $R'_o(i)$ outputted from the coefficient multiplying part 22.

According to the linear predictive analysis apparatus 2 of the first embodiment, because modified autocorrelation is obtained by multiplying autocorrelation by a coefficient $w_o(i)$ comprising a case where, according to the value having positive correlation with the pitch gain, for at least part of prediction order i, the magnitude of the coefficient $w_o(i)$ corresponding to the order i monotonically decreases as a value having positive correlation with a pitch gain in a signal section comprising all or part of an input signal $X_o(n)$ of the current frame increases, and a coefficient which can be converted into a linear predictive coefficient is obtained, even if the pitch gain of the input signal is high, it is possible to obtain the coefficient which can be converted into the linear predictive coefficient in which occurrence of a peak of spectrum due to pitch component is suppressed, and even if the pitch gain of the input signal is low, it is possible to obtain the coefficient which can be converted into the linear predictive coefficient which can express a spectral envelope, so that it is possible to realize linear prediction with higher precision than the conventional one. Therefore, quality of a decoded audio signal or a decoded acoustic signal obtained by encoding and decoding an audio signal or an acoustic signal at an encoding apparatus comprising the linear predictive analysis apparatus 2 of the first embodiment and at a decoding apparatus corresponding to the encoding apparatus is higher than quality of a decoded audio signal or a decoded acoustic signal obtained by encoding and decoding an audio signal or an acoustic signal at an encoding apparatus comprising the conventional linear predictive analysis apparatus and at a decoding apparatus corresponding to the encoding apparatus.

Second Embodiment

In the second embodiment, a value having positive correlation with a pitch gain of the input signal in the current frame or the past frame is compared with a predetermined threshold, and the coefficient $w_o(i)$ is determined according to the comparison result. The second embodiment is different from the first embodiment only in a method for determining the coefficient $w_o(i)$ at the coefficient determining part 24, and is the same as the first embodiment in other points. A portion different from the first embodiment will be mainly described below, and overlapped explanation of a portion which is the same as the first embodiment will be omitted.

A functional configuration of the linear predictive analysis apparatus 2 of the second embodiment and a flowchart of a linear predictive analysis method according to the linear predictive analysis apparatus 2 are the same as those of the first embodiment and illustrated in FIG. 1 and FIG. 2. The linear predictive analysis apparatus 2 of the second embodiment is the same as the linear predictive analysis apparatus 2 of the first embodiment except processing of the coefficient determining part 24.

Figure 3:
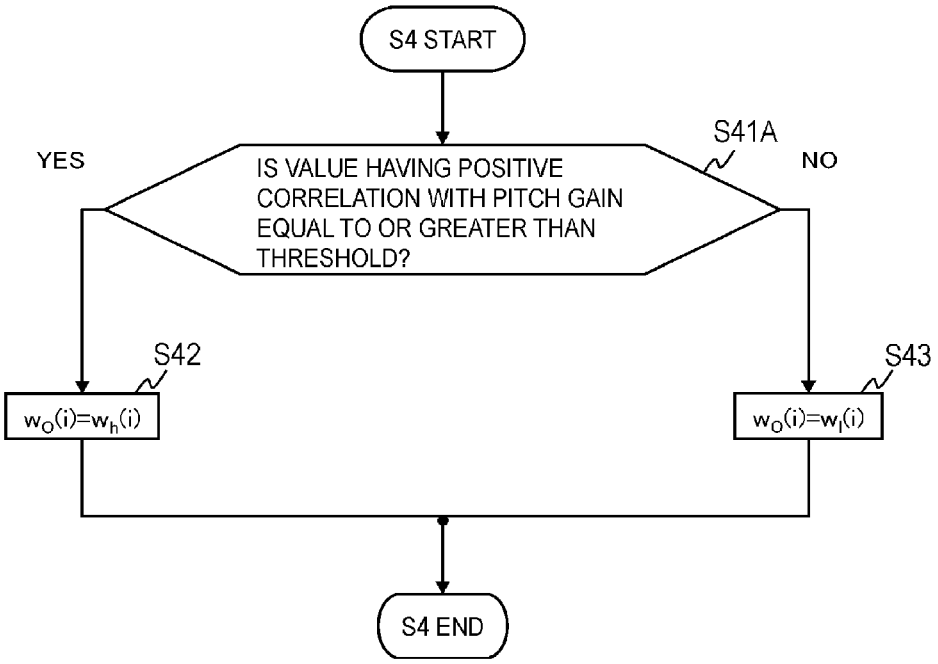
FIG. 3 is a flowchart for explaining an example of a linear predictive analysis method according to the second embodiment.

An example of flow of processing of the coefficient determining part 24 of the second embodiment is illustrated in FIG. 3. The coefficient determining part 24 of the second embodiment performs, for example, processing of each step S41A, step S42 and step S43 in FIG. 3.

The coefficient determining part 24 compares a value having positive correlation with a pitch gain corresponding to the inputted information regarding the pitch gain with a predetermined threshold (step S41A). The value having positive correlation with the pitch gain corresponding to the inputted information regarding the pitch gain is, for example, a pitch gain itself corresponding to the inputted information regarding the pitch gain.

When the value having positive correlation with the pitch gain is equal to or greater than the predetermined threshold, that is, when it is determined that the pitch gain is high, the coefficient determining part 24 determines a coefficient $w_h(i)$ according to a rule defined in advance and sets the determined coefficient $w_h(i)$ ($i=0, 1, \ldots, P_{max}$) as $w_o(i)$ ($i=0, 1, \ldots, P_{max}$) (step S42). That is, $w_o(i)=w_h(i)$.

When the value having positive correlation with the pitch gain is not equal to or greater than the predetermined threshold, that is, when it is determined that the pitch gain is low, the coefficient determining part 24 determines a coefficient $w_l(i)$ according to a rule defined in advance and sets the determined coefficient $w_l(i)$ ($i=0, 1, \ldots, P_{max}$) as $w_o(i)$ ($i=0, 1, \ldots, P_{max}$) (step S43). That is, $w_o(i)=w_h(i)$.

Here, $w_h(i)$ and $w_l(i)$ are determined so as to satisfy relationship of $w_h(i)<w_l(i)$ for at least part of each i. Alternatively, $w_h(i)$ and $w_l(i)$ are determined so as to satisfy relationship of $w_h(i)<w_l(i)$ for at least part of each i and $w_h(i)\leq w_l(i)$ for other i. Here, at least part of each i is, for example, i other than zero (that is, $1\leq i\leq P_{max}$). For example, $w_h(i)$ and $w_l(i)$ are obtained through a rule defined in advance by obtaining $w_o(i)$ when the pitch gain G is G1 in the equation (2) as $w_h(i)$ and obtaining $w_o(i)$ when the pitch gain G is G2 (where G1>G2) in the equation (2) as $w_l(i)$. Alternatively, for example, $w_h(i)$ and $w_l(i)$ are obtained through a rule defined in advance by obtaining $w_o(i)$ when $\alpha$ is $\alpha 1$ in the equation (2) as $w_h(i)$ and obtaining $w_o(i)$ when $\alpha$ is $\alpha 2$ (where $\alpha 1>\alpha 2$) as $w_l(i)$. In this case, $\alpha 1$ and $\alpha 2$ are defined in advance as with a in the equation (2). It should be noted that it is also possible to employ a configuration where $w_h(i)$ and $w_l(i)$ obtained in advance using any of these rules are stored in a table, and either $w_h(i)$ or $w_l(i)$ is selected from the table according to whether or not the value having positive correlation with the pitch gain is equal to or greater than the predetermined threshold. Further, each of $w_h(i)$ and $w_l(i)$ is determined so that values of $w_h(i)$ and $w_l(i)$ become smaller as i becomes greater. It should be noted that coefficients $w_h(i)$ and $w_l(i)$ when i=0 do not have to satisfy relationship of $w_h(0)\leq w_l(0)$, and may be values which satisfy relationship of $w_h(0)>w_l(0)$.

Also according to the second embodiment, as in the first embodiment, even if the pitch gain of the input signal is high, it is possible to obtain a coefficient which can be converted into a linear predictive coefficient in which occurrence of a peak of a spectrum due to pitch component is suppressed, and, even if the pitch gain of the input signal is low, it is possible to obtain a coefficient which can be converted into a linear predictive coefficient which can express a spectral envelope, so that it is possible to realize linear prediction with higher precision than the conventional one.

Modified Example of Second Embodiment

While, in the above-described second embodiment, the coefficient $w_o(i)$ is determined using one threshold, in the modified example of the second embodiment, the coefficient $w_o(i)$ is determined using two or more thresholds. A method for determining a coefficient using two thresholds of th1 and th2 will be described below as an example. The thresholds th1 and th2 satisfy relationship of 0<th1<th2.

A functional configuration of the linear predictive analysis apparatus 2 in the modified example of the second embodiment is the same as that of the second embodiment and illustrated in FIG. 1. The linear predictive analysis apparatus 2 of the modified example of the second embodiment is the same as the linear predictive analysis apparatus 2 of the second embodiment except processing of the coefficient determining part 24.

The coefficient determining part 24 compares the value having positive correlation with the pitch gain corresponding to the inputted information regarding the pitch gain with the thresholds th1 and th2. The value having positive correlation with the pitch gain corresponding to the inputted information regarding the pitch gain is, for example, a pitch gain itself corresponding to the inputted information regarding the pitch gain.

When the value having positive correlation with the pitch gain is greater than the threshold th2, that is, when it is determined that the pitch gain is high, the coefficient determining part 24 determines a coefficient $w_h(i)$ ($i=0, 1, \ldots, P_{max}$) according to a rule defined in advance and sets the determined coefficient $w_h(i)$ ($i=0, 1, \ldots, P_{max}$) as $w_o(i)$ ($i=0, 1, \ldots, P_{max}$). That is, $w_o(i)=w_h(i)$.

When the value having positive correlation with the pitch gain is greater than the threshold th1 and equal to or smaller than the threshold th2, that is, when it is determined that the pitch gain is medium, the coefficient determining part 24 determines a coefficient $w_m(i)$ ($i=0, 1, \ldots, P_{max}$) according to a rule defined in advance and sets the determined coefficient $w_m(i)$ ($i=0, 1, \ldots, P_{max}$) as $w_o(i)$ ($i=0, 1, \ldots, P_{max}$). That is, $w_o(i)=w_m(i)$.

When the value having positive correlation with the pitch gain is equal to or smaller than the threshold th1, that is, when it is determined that the pitch gain is low, the coefficient determining part 24 determines a coefficient $w_l(i)$ ($i=0, 1, \ldots, P_{max}$) according to a rule defined in advance and sets the determined coefficient $w_l(i)$ ($i=0, 1, \ldots, P_{max}$) as $w_o(i)$ ($i=0, 1, \ldots, P_{max}$). That is, $w_o(i)=w_l(i)$.

Here, it is assumed that for at least part of each i, $w_h(i)$, $w_m(i)$ and $w_l(i)$ are determined so as to satisfy relationship of $w_h(i)<w_m(i)<w_l(i)$. Here, at least part of each i is, for example, each i other than zero (that is, $1 \le i \le P_{max}$). Alternatively, for at least part of each i, $w_h(i)$, $w_m(i)$ and $w_l(i)$ are determined so as to satisfy relationship of $w_h(i)<w_m(i) \le w_l(i)$, and for at least part of each i among other i, $w_h(i)$, $w_m(i)$ and $w_l(i)$ are determined so as to satisfy relationship of $w_h(i) \le w_m(i)<w_l(i)$, and for the remaining at least part of each i, $w_h(i)$, $w_m(i)$ and $w_l(i)$ are determined so as to satisfy relationship of $w_h(i) \le w_m(i) \le w_l(i)$. For example, $w_h(i)$, $w_m(i)$ and $w_l(i)$ are obtained according to a rule defined in advance by obtaining $w_o(i)$ when the pitch gain G is G1 in the equation (2) as $w_h(i)$, obtaining $w_o(i)$ when the pitch gain G is G2 (where G1>G2) in the equation (2) as $w_m(i)$ and obtaining $w_o(i)$ when the pitch gain G is G3 (where G2>G3) in the equation (2) as $w_l(i)$. Alternatively, for example, $w_h(i)$, $w_m(i)$ and $w_l(i)$ are obtained according to a rule defined in advance by obtaining $w_o(i)$ when $\alpha$ is $\alpha 1$ in the equation (2) as $w_h(i)$, obtaining $w_o(i)$ when $\alpha$ is $\alpha 2$ (where $\alpha 1>\alpha 2$) in the equation (2) as $w_m(i)$ and obtaining $w_o(i)$ when $\alpha$ is $\alpha 3$ (where $\alpha 2>\alpha 3$) in the equation (2) as $w_l(i)$. In this case, $\alpha 1$, $\alpha 2$ and $\alpha 3$ are defined in advance as with a in the equation (2). It should be noted that it is also possible to employ a configuration where $w_h(i)$, $w_m(i)$ and $w_l(i)$ obtained in advance according to any of these rules are stored in a table and any of $w_h(i)$, $w_m(i)$ and $w_l(i)$ is selected from the table through comparison between the value having positive correlation with the pitch gain and the predetermined threshold.

It should be noted that the coefficient $w_m(i)$ which is between $w_h(i)$ and $w_l(i)$ may be determined using $w_h(i)$ and $w_l(i)$. That is, $w_m(i)$ may be determined through $w_m(i)=\beta' \times w_h(i)+(1-\beta) \times w_l(i)$. Here, $\beta'$ is $0 \le \beta' \le 1$, and is obtained from the pitch gain G through a function $\beta'=c(G)$ where the value of $\beta'$ becomes smaller when the value of the pitch gain G is smaller, and the value of $\beta'$ becomes greater when the value of the pitch gain G is greater. Because $w_m(i)$ is obtained in this manner, by storing only two tables of a table in which $w_h(i)$ ($i=0, 1, \ldots, P_{max}$) is stored and a table in which $w_l(i)$ ($i=0, 1, \ldots, P_{max}$) is stored in the coefficient determining part 24, when the pitch gain is high among cases where the pitch gain is medium, it is possible to obtain a coefficient close to $w_h(i)$, and, inversely, when the pitch gain is low among cases where the pitch gain is medium, it is possible to obtain a coefficient close to $w_l(i)$. Further, $w_h(i)$, $w_m(i)$ and $w_l(i)$ are determined so that each value of $w_h(i)$, $w_m(i)$ and $w_l(i)$ becomes smaller as i becomes greater. It should be noted that coefficients $w_h(0)$, $w_m(0)$ and $w_l(0)$ when i=0 do not have to satisfy relationship of $w_h(0) \le w_m(0) \le w_l(0)$, and may be values which satisfy relationship of $w_h(0)>w_m(0)$ or/and $w_m(0)>w_l(0)$.

Also according to the modified example of the second embodiment, as in the second embodiment, it is possible to obtain a coefficient which can be converted into a linear predictive coefficient where occurrence of a peak of a spectrum due to pitch component is suppressed even if the pitch gain of the input signal is high, and it is possible to obtain a coefficient which can be converted into a linear predictive coefficient which can express a spectral envelope even if the pitch gain of the input signal is low, so that it is possible to realize linear prediction with higher precision than the conventional one.

Third Embodiment

In the third embodiment, the coefficient $w_o(i)$ is determined using a plurality of coefficient tables. The third embodiment is different from the first embodiment only in a method for determining the coefficient $w_o(i)$ at the coefficient determining part 24, and is the same as the first embodiment in other points. A portion different from the first embodiment will be mainly described below, and overlapped explanation of a portion which is the same as the first embodiment will be omitted.

Figure 4:
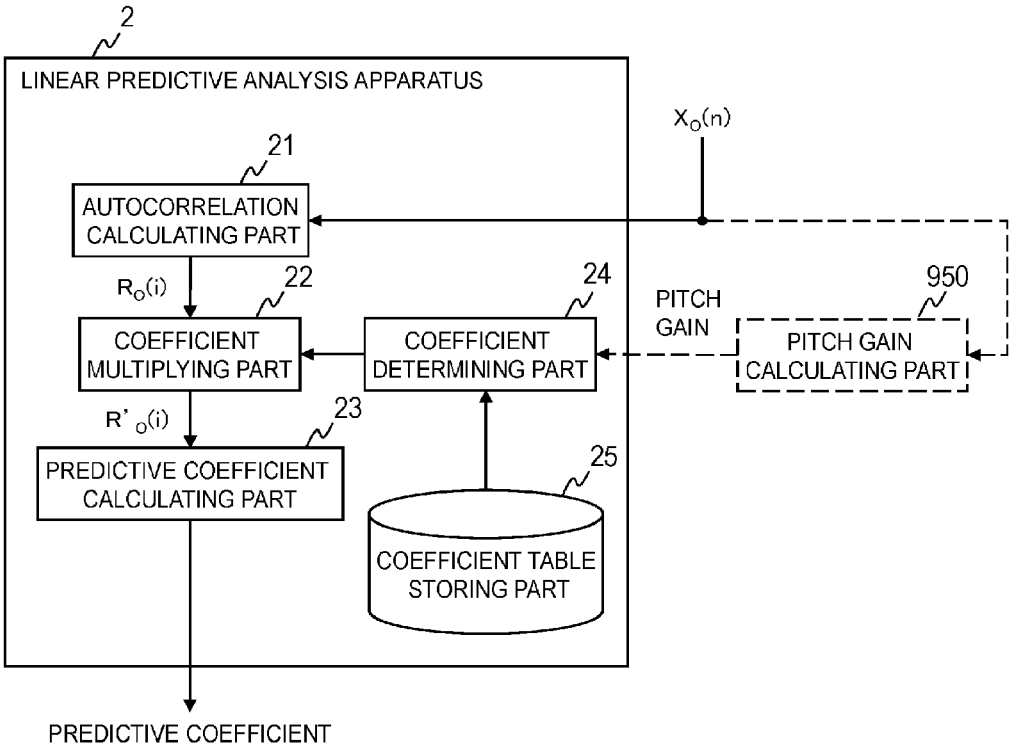
FIG. 4 is a block diagram for explaining an example of a linear predictive apparatus according to a third embodiment.

The linear predictive analysis apparatus 2 of the third embodiment is the same as the linear predictive analysis apparatus 2 of the first embodiment except processing of the coefficient determining part 24 and except that, as illustrated in FIG. 4, a coefficient table storing part 25 is further provided. In the coefficient table storing part 25, two or more coefficient tables are stored.

Figure 5:
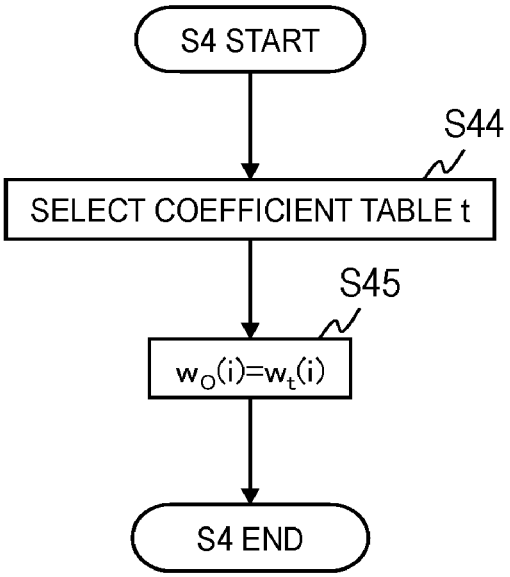
FIG. 5 is a flowchart for explaining an example of a linear predictive analysis method according to the third embodiment.

An example of flow of processing of the coefficient determining part 24 of the third embodiment is illustrated in FIG. 5. The coefficient determining part 24 of the third embodiment performs, for example, processing of step S44 and step S45 in FIG. 5.

First, the coefficient determining part 24 selects one coefficient table t corresponding to the value having positive correlation with the pitch gain from two or more coefficient tables stored in the coefficient table storing part 25 using the value having positive correlation with the pitch gain corresponding to the inputted information regarding the pitch gain (step S44). For example, the value having positive correlation with the pitch gain corresponding to the information regarding the pitch gain is a pitch gain corresponding to the information regarding the pitch gain.

It is assumed that, for example, different two coefficient tables t0 and t1 are stored in the coefficient table storing part 25, and a coefficient $w_{t0}(i)$ ($i=0, 1, \ldots, P_{max}$) is stored in the coefficient table t0, and a coefficient $w_{t1}(i)$ (i=0, 1, . . . , $P_{max}$) is stored in the coefficient table t1. In each of two coefficient tables t0 and t1, the coefficient $w_{t0}(i)$ (i=0, 1, . . . , $P_{max}$) and the coefficient $w_{t1}(i)$ (i=0, 1, . . . , $P_{max}$) determined so that $w_{t0}(i)<w_{t1}(i)$ for at least part of each i and $w_{t0}(i)\leq w_{t1}(i)$ for the remaining each i are stored.

At this time, the coefficient determining part 24 selects the coefficient table t0 as a coefficient table t if the value having positive correlation with the pitch gain specified by the inputted information regarding the pitch gain is equal to or greater than a predetermined threshold, otherwise, selects the coefficient table t1 as the coefficient table t. That is, when the value having positive correlation with the pitch gain is equal to or greater than the predetermined threshold, that is, when it is determined that the pitch gain is high, the coefficient determining part 24 selects a coefficient table with a smaller coefficient for each i, and, when the value having positive correlation with the pitch gain is smaller than the predetermined threshold, that is, when it is determined that the pitch gain is low, the coefficient determining part 24 selects a coefficient table with a greater coefficient for each i.

In other words, assuming that, among two coefficient tables stored in the coefficient table storing part 25, a coefficient table selected by the coefficient determining part 24 when the value having positive correlation with the pitch gain is a first value is set as a first coefficient table, and among two coefficient tables stored in the coefficient table storing part 25, a coefficient table selected by the coefficient determining part 24 when the value having positive correlation with the pitch gain is a second value which is smaller than the first value is set as a second coefficient table, for at least part of each order i, the magnitude of the coefficient corresponding to each order i in the second coefficient table is larger than the magnitude of the coefficient corresponding to each order i in the first coefficient table.

It should be noted that coefficients $w_{t0}(0)$ and $w_{t1}(0)$ when i=0 in the coefficient tables t0 and t1 stored in the coefficient table storing part 25 do not have to satisfy relationship of $w_{t0}(0)\leq w_{t1}(0)$, and may be values which have relationship of $w_{t0}(0)>w_{t1}(0)$.

Further, it is assumed that, for example, three different coefficient tables t0, t1 and t2 are stored in the coefficient table storing part 25, the coefficient $w_{t0}(i)$ (i=0, 1, . . . , $P_{max}$) is stored in the coefficient table t0, the coefficient $w_{t1}(i)$ (i=0, 1, . . . , $P_{max}$) is stored in the coefficient table t1, and a coefficient $w_{t2}(i)$ (i=0, 1, . . . , $P_{max}$) is stored in the coefficient table t2. In each of the three coefficient tables t0, t1 and t2, the coefficient $w_{t0}(i)$ (i=0, 1, . . . , $P_{max}$), the coefficient $w_{t1}(i)$ (i=0, 1, . . . , $P_{max}$) and the coefficient $w_{t2}(i)$ (i=0, 1, . . . , $P_{max}$) determined so that $w_{t0}(i)<w_{t1}(i)\leq w_{t2}(i)$ for at least part of each i, $w_{t0}(i)\leq w_{t1}(i)<w_{t2}(i)$ for at least part of each i among other i, and $w_{t0}(i)\leq w_{t1}(i)\leq w_{t2}(i)$ for the remaining each i are stored.

Here, it is assumed that two thresholds th1 and th2 which satisfy relationship of 0<th1<th2 are determined. At this time, the coefficient determining part 24

(1) selects the coefficient table t0 as the coefficient table t when the value having positive correlation with the pitch gain>th2, that is, when it is determined that the pitch gain is high, (2) selects the coefficient table t1 as the coefficient table t when th2 the value having positive correlation with the pitch gain>th1, that is, when it is determined that the pitch gain is medium, and (3) selects the coefficient table t2 as the coefficient table t when th1 the value having positive correlation with the pitch gain, that is, when it is determined that the pitch gain is low.

It should be noted that the coefficients $w_{t0}(0)$, $w_{t1}(0)$ and $w_{t2}(0)$ when i=0 of the coefficient tables t0, t1 and t2 stored in the coefficient table storing part 25 do not have to satisfy relationship of $w_{t0}(0)\leq w_{t1}(0)\leq w_{t2}(0)$, and may be values which have relationship of $w_{t0}(0)>w_{t1}(0)$ or/and $w_{t1}(0)>w_{t2}(0)$.

The coefficient determining part 24 sets the coefficient $w_t(i)$ of each order i stored in the selected coefficient table t as the coefficient $w_o(i)$ (step S45). That is, $w_o(i)=w_t(i)$. In other words, the coefficient determining part 24 acquires the coefficient $w_t(i)$ corresponding to each order i from the selected coefficient table t and sets the acquired coefficient $w_t(i)$ corresponding to each order i as $w_o(i)$.

In the third embodiment, unlike the first embodiment and the second embodiment, because it is not necessary to calculate the coefficient $w_o(i)$ based on the equation of the value having positive correlation with the pitch gain, it is possible to determine $w_o(i)$ with a less operation processing amount.

Specific Example of Third Embodiment

A specific example of the third embodiment will be described below. To the linear predictive analysis apparatus 2, an input signal $X_o(n)$ (n=0, 1, . . . , N−1) which is a digital acoustic signal of N samples per one frame, which passes through a high-pass filter, is subjected to sampling conversion to 12.8 kHz and subjected to pre-emphasis processing, and a pitch gain G obtained at the pitch gain calculating part 950 for an input signal $X_o(n)$ (n=0, 1, . . . , Nn) (where Nn is a positive predetermined integer which satisfies relationship of Nn<N) of part of the current frame as information regarding the pitch gain, are inputted. The pitch gain G for the input signal $X_o(n)$ (n=0, 1, . . . , Nn) of part of the current frame is a pitch gain calculated and stored for $X_o(n)$ (n=0, 1, . . . , Nn) in processing of the pitch gain calculating part 950 performed for a signal section of the frame one frame before the current frame while the input signal $X_o(n)$ (n=0, 1, . . . , Nn) of part of the current frame is comprised as the signal section of the frame one frame before the input signal at the pitch gain calculating part 950.

The autocorrelation calculating part 21 obtains autocorrelation $R_o(i)$ (i=0, 1, . . . , $P_{max}$) from the input signal $X_o(n)$ using the following equation (8).

[Formula 10]

$$R_o(i) = \sum_{n=i}^{N-1} X_o(n) \times X_o(n-i) \tag{8}$$

The pitch gain G which is information regarding the pitch gain is inputted to the coefficient determining part 24.

It is assumed that the coefficient table t0, the coefficient table t1 and the coefficient table t2 are stored in the coefficient table storing part 25.

In the coefficient table t0 which is a coefficient table where $f_0$=60 Hz in the conventional method of the equation (13), a coefficient $w_{t0}(i)$ of each order is defined as follows.

$w_{t0}(i)$=[1.0001, 0.999566371, 0.998266613, 0.996104103, 0.993084457, 0.989215493, 0.984507263, 0.978971839, 0.972623467, 0.96547842, 0.957554817, 0.948872864, 0.939454317, 0.929322779, 0.918503404, 0.907022834, 0.894909143]

In the coefficient table t1 which is a table where $f_0$=40 Hz in the conventional method of the equation (13), a coefficient $w_{t1}(i)$ of each order is defined as follows.

$w_{t1}(i)$=[1.0001, 0.999807253, 0.99922923, 0.99826661, 0.99692050, 0.99519245, 0.99308446, 0.99059895, 0.98773878, 0.98450724, 0.98090803, 0.97694527, 0.97262346, 0.96794752, 0.96292276, 0.95755484, 0.95184981]

In the coefficient table t2 which is a table where $f_0$=20 Hz in the conventional method of the equation (13), a coefficient $w_{t2}(i)$ of each order is defined as follows.

$w_{t2}(i)$=[1.0001, 0.99995181, 0.99980725, 0.99956637, 0.99922923, 0.99879594, 0.99826661, 0.99764141, 0.99692050, 0.99610410, 0.99519245, 0.99418581, 0.99308446, 0.99188872, 0.99059895, 0.98921550, 0.98773878]

Here, in the above-described lists of $w_{t0}(i)$, $w_{t1}(i)$ and $w_{t2}(i)$, magnitudes of the coefficient corresponding to i are arranged from the left in order of i=0, 1, 2, . . . , 16 assuming that $P_{max}$=16. That is, in the above-described example, for example, $w_{t0}(0)$=1.0001, and $w_{t0}(3)$=0.996104103.

Figure 6:
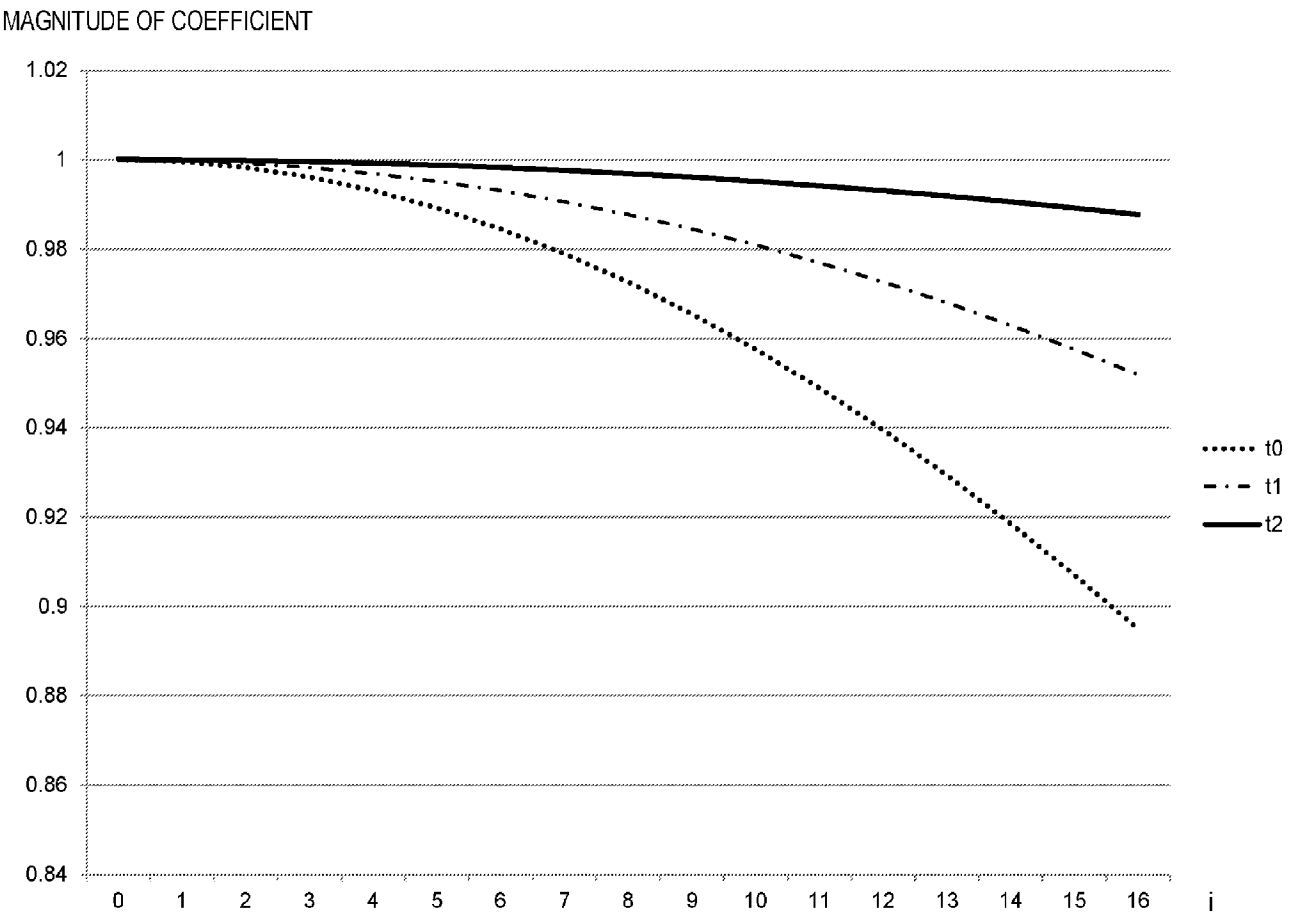
FIG. 6 is a diagram for explaining a specific example of the third embodiment.

FIG. 6 is a graph illustrating magnitudes of coefficients $w_{t0}(i)$, $w_{t1}(i)$ and $w_{t2}(i)$ of the coefficient tables t0, t1 and t2. A dotted line in the graph of FIG. 6 indicates the magnitude of the coefficient $w_{t0}(i)$ of the coefficient table t0, a dashed-dotted line in the graph of FIG. 6 indicates the magnitude of the coefficient $w_{t1}(i)$ of the coefficient table t1, and a solid line in the graph of FIG. 6 indicates the magnitude of the coefficient $w_{t2}(i)$ of the coefficient table t2. FIG. 6 illustrates an order i on the horizontal axis and illustrates the magnitudes of the coefficients on the vertical axis. As can be seen from this graph, in each coefficient table, the magnitudes of the coefficients monotonically decrease as the value of i increases. Further, when the magnitudes of the coefficients are compared in different coefficient tables corresponding to the same value of i, for i of i≥1 except zero, in other words, for at least part of i, relationship of $w_{t0}(i)<w_{t1}(i)<w_{t2}(i)$ is satisfied. The plurality of coefficient tables stored in the coefficient table storing part 25 are not limited to the above-described examples if a table has such relationship.

Further, as disclosed in Non-patent literature 1 and Non-patent literature 2, it is also possible to make an exception for only a coefficient when i=0 and use an experimental value such as $w_{t0}(0)=w_{t1}(0)=w_{t2}(0)$=1.0001 or $w_{t0}(0)=w_{t1}(0)=w_{t2}(0)$=1.003. It should be noted that i=0 does not have to satisfy relationship of $w_{t0}(i)<w_{t1}(i)<w_{t2}(i)$, and $w_{t0}(0)$, $w_{t1}(0)$ and $w_{t2}(0)$ do not necessarily have to be the same value. For example, magnitude relationship of two or more values among $w_{t0}(0)$, $w_{t1}(0)$ and $w_{t2}(0)$ does not have to satisfy relationship of $w_{t0}(i)<w_o(i)<w_{t2}(i)$ only concerning i=0.

While the above-described coefficient table t0 corresponds to a coefficient value when $f_0$=60 Hz, and $f_s$=12.8 kHz in the equation (13), the coefficient table t1 corresponds to a coefficient value when $f_0$=40 Hz, and $f_s$=12.8 kHz in the equation (13), and the coefficient table t2 corresponds to a coefficient value when $f_0$=20 Hz, these tables respectively correspond to a coefficient value when f(G)=60, and $f_s$=12.8 kHz in the equation (2A), a coefficient value when f(G)=40 and $f_s$=12.8 kHz, and a coefficient value when f(G)=20 and $f_s$=12.8 kHz, and the function f(G) in the equation (2A) is a function which has positive correlation with the pitch gain G. That is, when coefficient values of three coefficient tables are defined in advance, it is possible to obtain a coefficient value through the equation (13) using three $f_0$ defined in advance instead of obtaining a coefficient value through the equation (2A) using three pitch gains defined in advance.

The coefficient determining part 24 compares the inputted pitch gain G with predetermined threshold th1=0.3 and threshold th2=0.6 and selects the coefficient table t2 when G≤0.3, selects the coefficient table t1 when 0.3<G≤0.6, and selects the coefficient table t0 when 0.6<G.

The coefficient determining part 24 sets each coefficient $w_t(i)$ of the selected coefficient table t as the coefficient $w_o(i)$. That is, $w_o(i)=w_t(i)$. In other words, the coefficient determining part 24 acquires the coefficient $w_t(i)$ corresponding to each order i from the selected coefficient table t and sets the acquired coefficient $w_t(i)$ corresponding to each order i as $w_o(i)$.

Modified Example of Third Embodiment

While, in the third embodiment, a coefficient stored in any one table among the plurality of coefficient tables is determined as the coefficient $w_o(i)$, the modified example of the third embodiment further comprises a case where the coefficient $w_o(i)$ is determined through operation processing based on coefficients stored in the plurality of coefficient tables in addition to the above-described case.

A functional configuration of the linear predictive analysis apparatus 2 of the modified example of the third embodiment is the same as that of the third embodiment and illustrated in FIG. 4. The linear predictive analysis apparatus 2 of the modified example of the third embodiment is the same as the linear predictive analysis apparatus 2 of the third embodiment except the processing of the coefficient determining part 24 and coefficient tables comprised in the coefficient table storing part 25.

Only the coefficient tables t0 and t2 are stored in the coefficient table storing part 25, and the coefficient $w_{t0}(i)$=0, 1, . . . , $P_{max}$) is stored in the coefficient table t0, and the coefficient $w_o(i)$ (i=0, 1, . . . , $P_{max}$) is stored in the coefficient table t2. In each of the two coefficient tables t0 and t2, the coefficient $w_{t0}(i)$ (i=0, 1, . . . , $P_{max}$) and the coefficient $w_{t2}(i)$ (i=0, 1, . . . , $P_{max}$) determined so that $w_{t0}(i)<w_{t2}(i)$ for at least part of each i, and $w_{t0}(i)<w_{t2}(i)$ for the remaining each i, are stored.

Here, it is assumed that two thresholds th1 and th2 which satisfy relationship of 0<th1<th2 are defined. At this time, the coefficient determining part 24

(1) selects each coefficient $w_{t0}(i)$ in the coefficient table t0 as the coefficient $w_o(i)$ when the value having positive correlation with the pitch gain>th2, that is, when it is determined that the pitch gain is high, (2) determines the coefficient $w_o(i)$ through $w_o(i)=\beta'\times w_{t0}(i)+(1-\beta'\times w_{t2}(i)$ using each coefficient $w_{t0}(i)$ in the coefficient table t0 and each coefficient $w_{t2}(i)$ in the coefficient table t2 when th2 the value having positive correlation with the pitch gain>th1, that is, when it is determined that the pitch gain is medium, and (3) selects each coefficient $w_{t2}(i)$ in the coefficient table t2 as the coefficient $w_o(i)$ when th1≥the value having positive correlation with the pitch gain, that is, when it is determined that the pitch gain is low.

Here, β' is a value which satisfies 0≤β'≤1 and which is obtained from the pitch gain G using a function β'=c(G) where the value of β' becomes smaller when the value of the pitch gain G is smaller and the value of β' becomes greater when the value of the pitch gain G is greater. According to this configuration, when the pitch gain G is low among cases where the pitch gain is medium, it is possible to set a value close to $w_{t2}(i)$ as the coefficient $w_o(i)$, and, inversely, when the pitch gain G is high among cases where the pitch gain is medium, it is possible to set a value closed to $w_{t0}(i)$ as the coefficient $w_o(i)$, so that it is possible to obtain three or more coefficients $w_o(i)$ only from two tables.

It should be noted that coefficients $w_{t0}(0)$ and $w_{t2}(0)$ when i=0 in the coefficient tables t0 and t2 stored in the coefficient table storing part 25 do not have to satisfy relationship of $w_{t0}(0) \leq w_{t2}(0)$ and may be values which satisfy relationship of $w_{t0}(0) > w_{t2}(0)$.

Modified Example Common to First Embodiment to Third Embodiment

Figure 7:
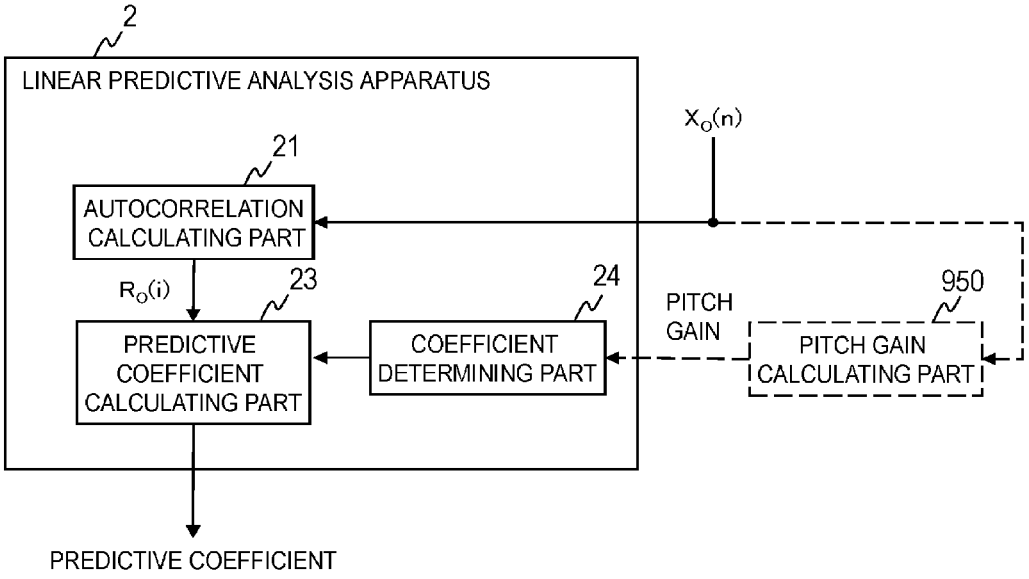
FIG. 7 is a block diagram for explaining a modified example.
Figure 8:
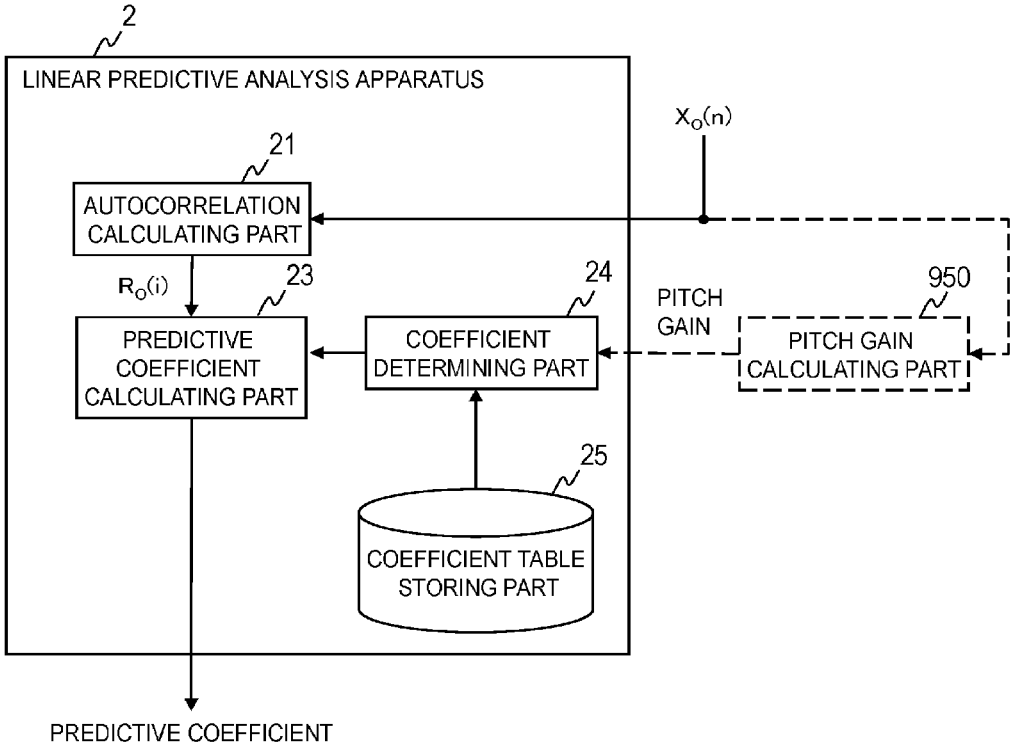
FIG. 8 is a block diagram for explaining a modified example.
Figure 9:
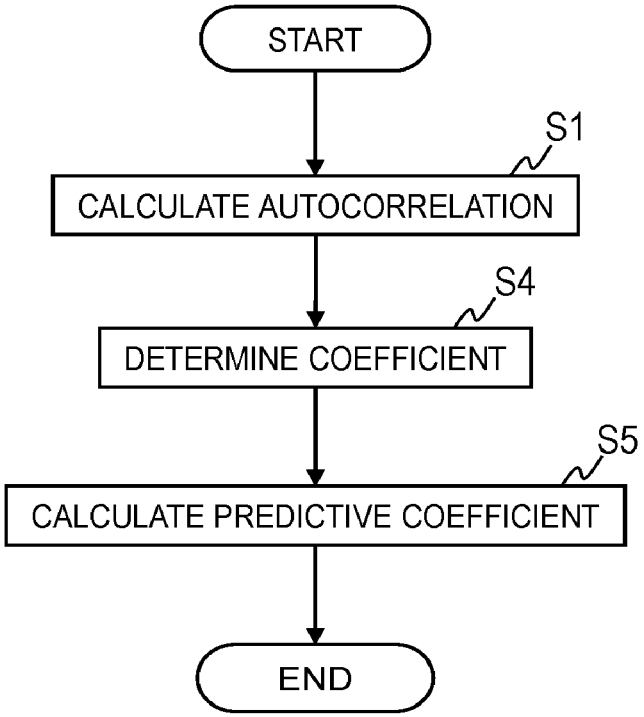
FIG. 9 is a flowchart for explaining a modified example.

As illustrated in FIG. 7 and FIG. 8, in all the above-described embodiments and modified examples, it is also possible to perform linear predictive analysis using the coefficient $w_o(i)$ and the autocorrelation $R_o(i)$ at the predictive coefficient calculating part 23 without comprising the coefficient multiplying part 22. FIG. 7 and FIG. 8 illustrate configuration examples of the linear predictive analysis apparatus 2 respectively corresponding to FIG. 1 and FIG. 4. In this case, the predictive coefficient calculating part 23 performs linear predictive analysis directly using the coefficient $w_o(i)$ and the autocorrelation $R_o(i)$ instead of using the modified autocorrelation $R'_o(i)$ obtained by multiplying the autocorrelation $R_o(i)$ by the coefficient $w_o(i)$ in step S5 in FIG. 9 (step S5).

Fourth Embodiment

In the fourth embodiment, linear predictive analysis is performed on the input signal $X_o(n)$ using the conventional linear predictive analysis apparatus, a pitch gain is obtained at the pitch gain calculating part using the result of the linear predictive analysis, and a coefficient which can be converted into a linear predictive coefficient is obtained by the linear predictive analysis apparatus of the present invention using the coefficient $w_o(i)$ based on the obtained pitch gain.

Figure 10:
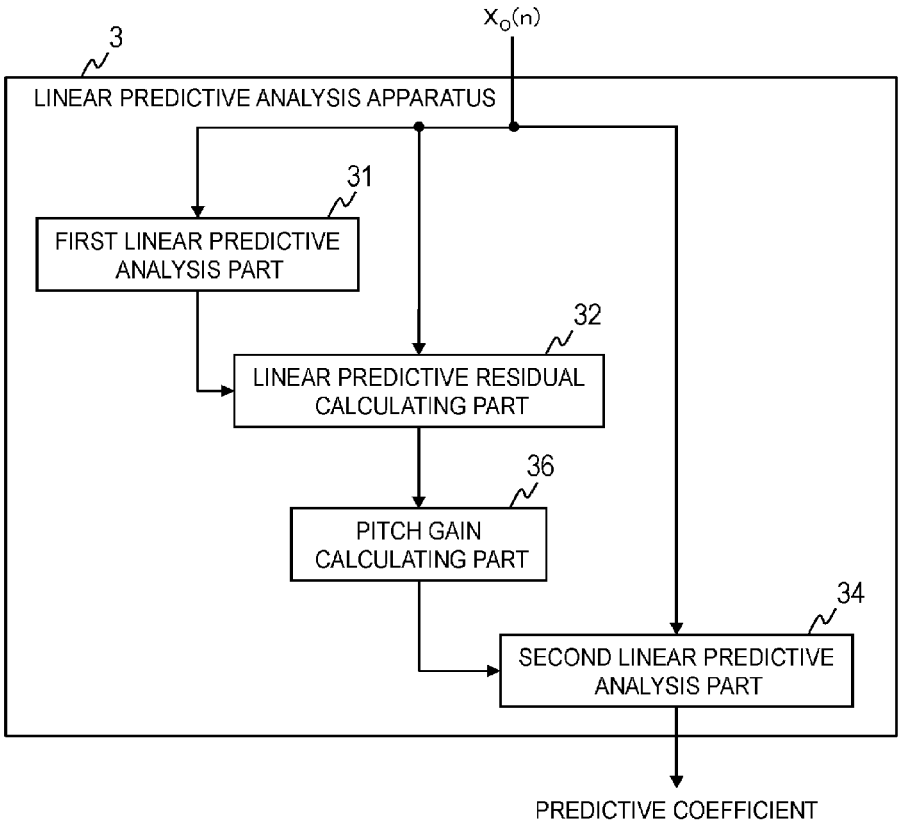
FIG. 10 is a block diagram for explaining an example of a linear predictive analysis apparatus according to a fourth embodiment.
Figure 11:
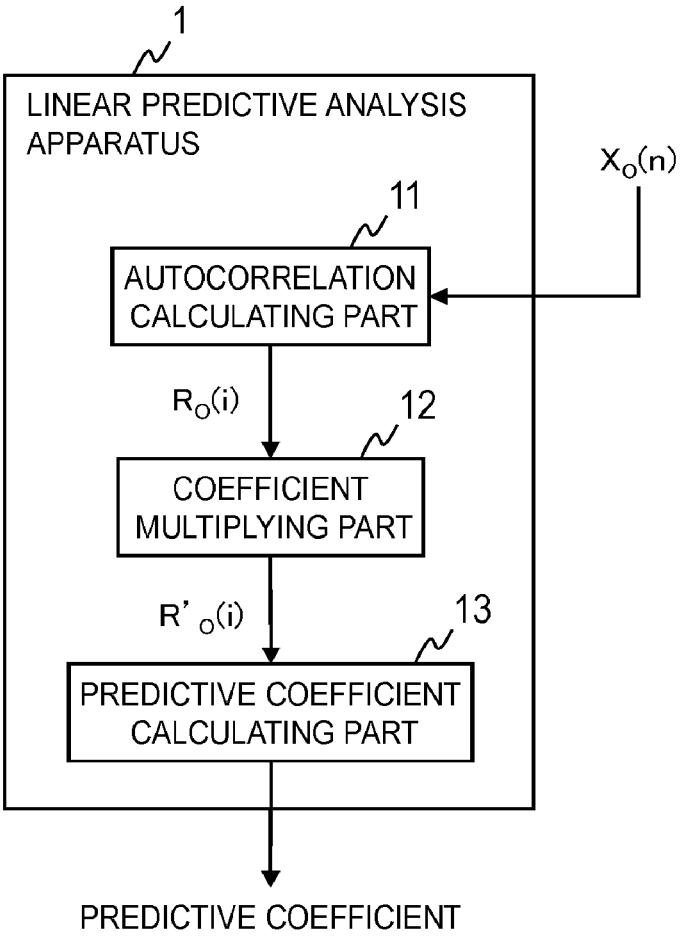
FIG. 11 is a block diagram for explaining an example of a conventional linear predictive apparatus.

As illustrated in FIG. 10, a linear predictive analysis apparatus 3 of the fourth embodiment comprises, for example, a first linear predictive analysis part 31, a linear predictive residual calculating part 32, a pitch gain calculating part 36 and a second linear predictive analysis part 34.

[First Linear Predictive Analysis Part 31]

The first linear predictive analysis part 31 performs the same operation as that of the conventional linear predictive analysis apparatus 1. That is, the first linear predictive analysis part 31 obtains autocorrelation $R_o(i)$ (i=0, 1, . . . , $P_{max}$) from the input signal $X_o(n)$, obtains modified autocorrelation $R'_n(i)$ (i=0, 1, . . . , $P_{max}$) by multiplying the autocorrelation $R_o(i)$ (i=0, 1, . . . , $P_{max}$) by the coefficient $w_o(i)$ (i=0, 1, . . . , $P_{max}$) defined in advance for each of the same i, and obtains a coefficient which can be converted into linear predictive coefficients from the first-order to the $P_{max}$-order which is a maximum order defined in advance from the modified autocorrelation $R'_n(i)$ (i=0, 1, . . . , $P_{max}$).

[Linear Predictive Residual Calculating Part 32]

The linear predictive residual calculating part 32 obtains a linear predictive residual signal $X_R(n)$ by performing linear prediction based on the coefficient which can be converted into linear predictive coefficients from the first-order to the $P_{max}$-order or performing filtering processing which is equivalent to or similar to the linear prediction on the input signal $X_o(n)$.

Because the filtering processing can be referred to as weighting processing, the linear predictive residual signal $X_R(n)$ can be referred to as a weighted input signal.

[Pitch Gain Calculating Part 36]

The pitch gain calculating part 36 obtains the pitch gain G of the linear predictive residual signal $X_R(n)$ and outputs information regarding the pitch gain. Because there are various publicly known methods for obtaining a pitch gain, any publicly known method may be used. The pitch gain calculating part 36, for example, obtains a pitch gain for each of a plurality of subframes constituting the linear predictive residual signal $X_R(n)$ (n=0, 1, . . . , N−1) of the current frame. That is, the pitch gain calculating part 36 obtains $G_{s1}$, . . . , $G_{sM}$ which are respective pitch gains of $X_{Rs1}(n)$ (n=0, 1, . . . , N/M−1), . . . , $X_{RsM}(n)$ (n=M−1)N/M, (M−1)N/M+1, . . . , N−1) which are M subframes where M is two or more integers. It is assumed that N is divisible by M. The pitch gain calculating part 36 subsequently outputs information which can specify a maximum value max ($G_{s1}$, . . . , $G_{sM}$) among $G_{s1}$, . . . , $G_{sM}$ which are pitch gains of M subframes constituting the current frame as the information regarding the pitch gain.

[Second Linear Predictive Analysis Part 34]

The second linear predictive analysis part 34 performs the same operation as that of any of the linear predictive analysis apparatuses 2 in the first embodiment to the third embodiment and modified examples of these embodiments of the present invention. That is, the second linear predictive analysis part 34 obtains autocorrelation $R_o(i)$ (i=0, 1, . . . , $P_{max}$) from the input signal $X_o(n)$, determines the coefficient $w_o(i)$=0, 1, . . . , $P_{max}$) based on the information regarding the pitch gain outputted from the pitch gain calculating part 36, and obtains a coefficient which can be converted into linear predictive coefficients from the first-order to the $P_{max}$-order which is a maximum order defined in advance from modified autocorrelation (i=1, . . . , $P_{max}$) using the autocorrelation $R_o(i)$ (i=0, 1, . . . , $P_{max}$) and the determined coefficient $w_o(i)$ (i=0, 1, . . . , $P_{max}$).

<Concerning Value Having Positive Correlation with Pitch Gain>

As described as the specific example 2 of the pitch gain calculating part 950 in the first embodiment, it is also possible to use a pitch gain of a portion corresponding to a sample of the current frame among a sample portion to be looked ahead and utilized which is called a look-ahead portion in signal processing of the previous frame as the value having positive correlation with the pitch gain.

Further, it is also possible to use an estimate value of the pitch gain as the value having positive correlation with the pitch gain. For example, an estimate value of the pitch gain regarding the current frame predicted from pitch gains in a plurality of past frames, or an average value, a minimum value, a maximum value or a weighted linear sum of pitch gains for a plurality of past frames may be used as the estimate value of the pitch gain. Further, an average value, a minimum value, a maximum value or a weighted linear sum of the pitch gains of a plurality of subframes may be used as the estimate value of the pitch gain.

Further, as the value having positive correlation with the pitch gain, a quantization value of the pitch gains may be used. That is, a pitch gain before quantization may be used, or a pitch gain after quantization may be used.

It should be noted that in comparison between the value having positive correlation with the pitch gain and the threshold in the above-described each embodiment and each modified example, it is only necessary to perform setting such that a case where the value having positive correlation with the pitch gain is equal to the threshold is classified into either of two adjacent cases which are differentiated by the threshold as a borderline. That is, a case where the value is equal to or greater than a given threshold may be made a case where the value is greater than the threshold, and a case where the value is smaller than the threshold may be made a case where the value is equal to or smaller than the threshold. Further, a case where the value is greater than a given threshold may be made a case where the value is equal to or greater than the threshold, and a case where the value is equal to or smaller than the threshold may be made a case where the value is smaller than the threshold.

The processing described in the above-described apparatus and method is not only executed in time series according to the order the processing is described, but may be executed in parallel or individually according to processing performance of the apparatus which executes the processing or as necessary.

Further, when each step in the linear predictive analysis method is implemented using a computer, processing content of a function of the linear predictive analysis method is described in a program. By this program being executed at the computer, each step is implemented on the computer.

The program which describes the processing content can be stored in a computer readable recording medium. As the computer readable recording medium, for example, any of a magnetic recording apparatus, an optical disc, a magnetooptical recording medium, a semiconductor memory, or the like, may be used.

Further, each processing part may be configured by causing a predetermined program to be executed on a computer, or at least part of the processing content may be implemented using hardware.

Other modifications are, of course, possible without deviating from the gist of the present invention.

What is claimed is:

1. A linear predictive analysis method for obtaining a coefficient which can be converted into a linear predictive coefficient corresponding to an input time series signal for each frame which is a predetermined time interval, the linear predictive analysis method comprising:

an autocorrelation calculating step of calculating autocorrelation $R_o(i)$ between an input time series signal $X_o(n)$ of a current frame and an input time series signal $X_o(n-i)$ i sample before the input time series signal $X_0(n)$ or an input time series signal $X_o(n+i)$ sample after the input time series signal $X_o(n)$ for each of at least i=0, 1, . . . , $P_{max}$; and a predictive coefficient calculating step of obtaining a coefficient which can be converted into linear predictive coefficients from the first-order to the $P_{max}$-order using modified autocorrelation $R'_o(i)$ obtained by multiplying the autocorrelation $R_o(i)$ by a coefficient $w_o(i)$ for each corresponding i, wherein a case is comprised where, for at least part of each order i, the coefficient $w_o(i)$ corresponding to each order i monotonically decreases as a value having positive correlation with intensity of periodicity of an input time series signal of the current frame or a past frame or a pitch gain based on the input time series signal increases.

2. A linear predictive analysis apparatus which obtains a coefficient which can be converted into a linear predictive coefficient corresponding to an input time series signal for each frame which is a predetermined time interval, the linear predictive analysis apparatus comprising:

processing circuitry configured to calculate autocorrelation $R_o(i)$ between an input time series signal $X_o(n)$ of a current frame and an input time series signal $X_o(n-i)$ i sample before the input time series signal $X_o(n)$ or an input time series signal $X_o(n+i)$ i sample after the input time series signal $X_o(n)$ for each of at least i=0, 1, . . . , $P_{max}$; and obtain a coefficient which can be converted into linear predictive coefficients from the first-order to the $P_{max}$-order using modified autocorrelation $R'_o(i)$ obtained by multiplying the autocorrelation $R_o(i)$ by a coefficient $w_o(i)$ for each corresponding i, wherein a case will be comprised where, for at least part of each order i, the coefficient $w_o(i)$ corresponding to the each order i monotonically decreases as a value having positive correlation with intensity of periodicity of an input time series signal of the current frame or a past frame or a pitch gain based on the input time series signal increases.

3. A non-transitory computer readable recording medium in which a program causing a computer to execute each step of the linear predictive analysis method according to claim 1 is recorded.

* * * * *